United States Patent [19]

Simon

[11] 4,447,158

[45] May 8, 1984

[54] APPARATUS AND METHOD FOR MIXING PARTICULATE MATERIAL

[76] Inventor: Clarence W. Simon, P.O. Box 714, Scott City, Kans. 67871

[21] Appl. No.: 327,962

[22] Filed: Dec. 7, 1981

[51] Int. Cl.[3] ..... B01F 7/08

[52] U.S. Cl. ..... 366/297; 474/88; 474/91

[58] Field of Search ..... 366/66, 272, 282, 283, 366/297, 603, 349, 297, 300; 474/88, 86, 91; 74/467; 184/13 R, 15 R, 61

[56] References Cited

U.S. PATENT DOCUMENTS

| | | | |
|---|---|---|---|
| 1,670,471 | 5/1928 | Merkt | 184/13 R |
| 1,693,812 | 12/1928 | Edwards | 184/13 R |
| 1,771,835 | 7/1930 | Bartlett | 184/13 R |
| 3,672,640 | 6/1972 | Crose | 366/300 |
| 3,706,442 | 12/1972 | Peat | 366/300 X |
| 3,797,807 | 3/1974 | Behrens | 366/300 X |

FOREIGN PATENT DOCUMENTS

| | | | |
|---|---|---|---|
| 143174 | 8/1980 | German Democratic Rep. | 184/13 R |

*Primary Examiner*—Robert W. Jenkins
*Attorney, Agent, or Firm*—John H. Widdowson

[57] ABSTRACT

Apparatus for mixing particulate material in the bed of a truck having a mixing chamber, a plurality of augers rotatably disposed within the chamber, and a plurality of sprockets and chains for driving the augers from power takeoff from the truck. A lower oil tank is attached to a housing that houses the sprockets and chains. The oil tank contains oil. The method comprises utilizing one of the chains to transport some of the oil from the oil tank for self-oiling of the sprockets and the remaining chains.

4 Claims, 12 Drawing Figures

FIG. 6
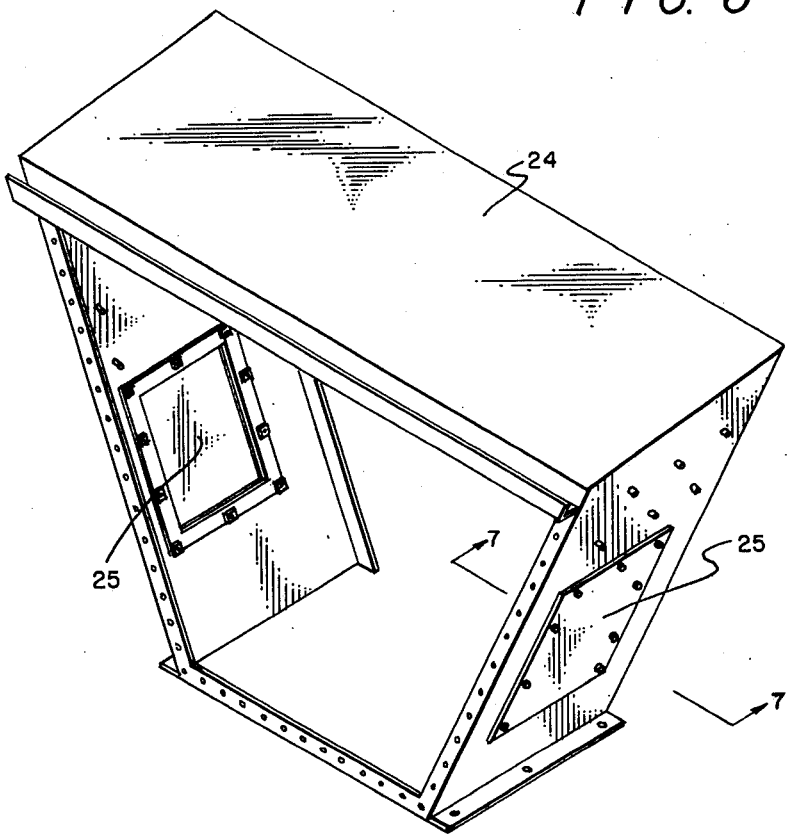
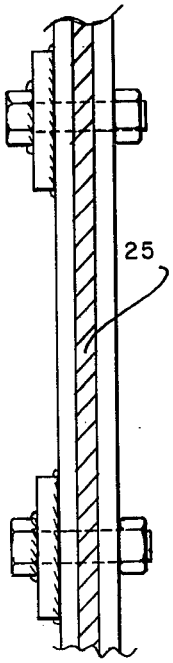
FIG. 7
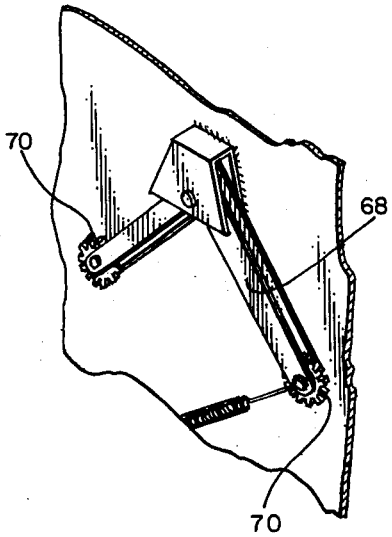
FIG. 8

APPARATUS AND METHOD FOR MIXING PARTICULATE MATERIAL

BACKGROUND OF THE INVENTION

1. Field of the Invention

This invention provides an apparatus and method for mixing particulate material. More specifically, this invention contemplates an apparatus and method for mixing particulate material on the bed of a truck.

2. Description of the Prior Art

U.S. Pat. No. 3,706,442 by Peat relates to a mobile feed mixer wherein the truck body is provided with a plurality of augers that may be driven by a source of power from the vehicle to affect mixing of the feed in transit. U.S. Pat. No. 4,153,376 by Neier shows the mixing means operated by hydraulic motors supplied by power from the vehicle. None of the foregoing prior art teaches or suggests the inventive features of this invention.

SUMMARY OF THE INVENTION

This invention accomplishes its desired objects by providing an apparatus for mixing particulate material in the bed of a truck. The apparatus comprises a mixing chamber, and a plurality of auger means rotatably disposed within the chamber for moving and mixing the particulate material. Auger driving means engages the auger means for rotating the same; the auger means includes a master drive chain means. An auger driving housing encloses the auger driving means. Power means powers the auger driving means. A lower oil tank means is secured to the housing and contains a reservoir of oil in contact with the drive chain means and wherefrom the drive chain means picks up oil for self-oiling and scrubbing of the features included within the auger rotating driving means. The invention also accomplishes its desired objects by providing a method for moving and mixing particulate matter comprising the steps of: (a) disposing a plurality of rotatable augers within the mixing chamber; (b) engaging the augers of step (a) with auger driving means having a master drive chain means powered from power transmitted to the auger driving means; (c) housing the auger driving means; (d) securing a lower oil tank means having a reservoir of oil to the housing of step (c); and (e) contacting the drive chain means of step (b) with the oil of step (d) such that the drive chain means picks up oil from the lower oil tank means for self-oiling and scrubbing of the features included within the auger rotating driving means simultaneous to the moving and mixing of the particulate matter in the mixing chamber.

It is an object of the invention to provide an apparatus and method for mixing particulate matter on the bed on a truck.

Still further objects of the invention reside in the provision of an apparatus and method for mixing particulate matter which is relatively inexpensive to manufacture and which has self-oiling and scrubbing features.

These, together with the various ancillary objects and features which will become apparent as the following description proceeds, are attained by this invention, preferred embodiments being shown in the accompanying drawings, by way of example only, wherein:

BRIEF DESCRIPTION OF THE DRAWINGS

FIG. 6 is a perspective view of the auger housing;

FIG. 7 is a partial vertical sectional view taken in direction of the arrows and along the plane of line 7—7 in FIG. 6;

FIG. 8 is a perpsective view of the rocker arm assembly;

DETAILED DESCRIPTION OF THE INVENTION

Figure 9:
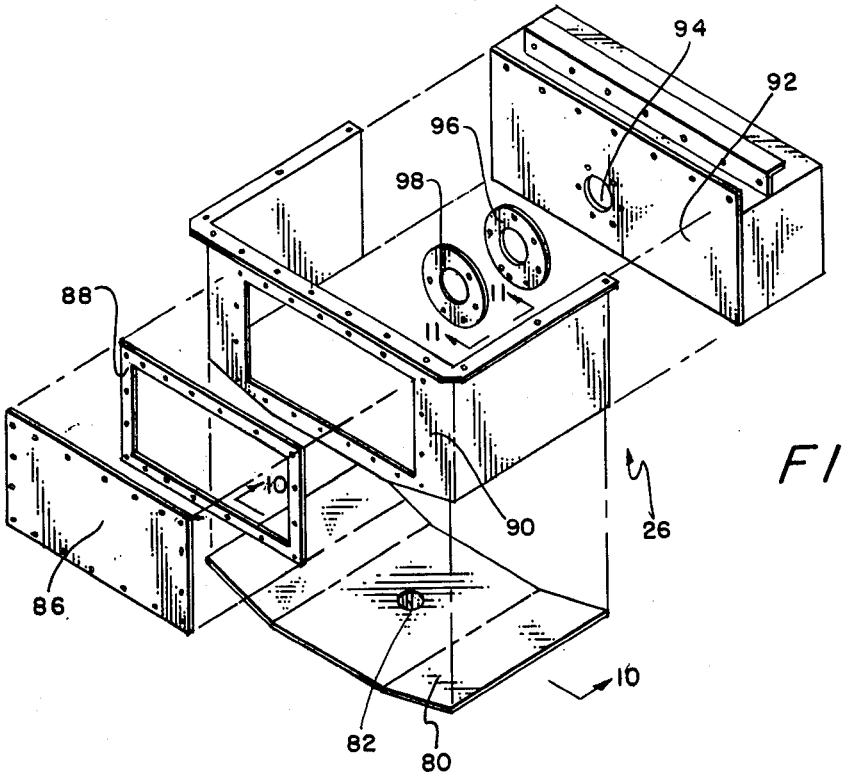
FIG. 9 is a segmented perspective detail view of the parts of the lower oil tank.
Figure 11:
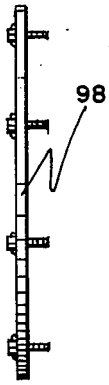
FIG. 11 is a side elevational view taken in direction of the arrows and along the plane of line 11—11 in FIG. 9.
Figure 10:
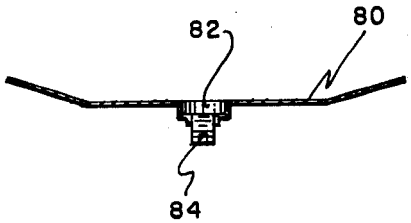
FIG. 10 is a vertical sectional view of the bottom of the oil tank disclosing the plug.

Referring in detail now to the drawings, wherein like reference numerals designate similar parts throughout the various views, there is seen the apparatus for mixing particulate material, generally illustrated as 10, on the bed 12 of a truck, generally illustrated as 14. The apparatus 10 comprises a mixing chamber 16 including a plurality of rotatably disposed augers 18 therein with flight sections 20. Auger driving means, generally illustrated as 22 (see FIG. 3), is housed in compartment 24 and engages the augers 18 for rotating the same. A lower oil tank, generally illustrated as 26 (see FIG. 9), is secured to the bottom of the compartment 24 and contains a reservoir of oil. Compartment 24 has a pair of inspection doors 25—25 (see FIG. 6).

Figure 1:
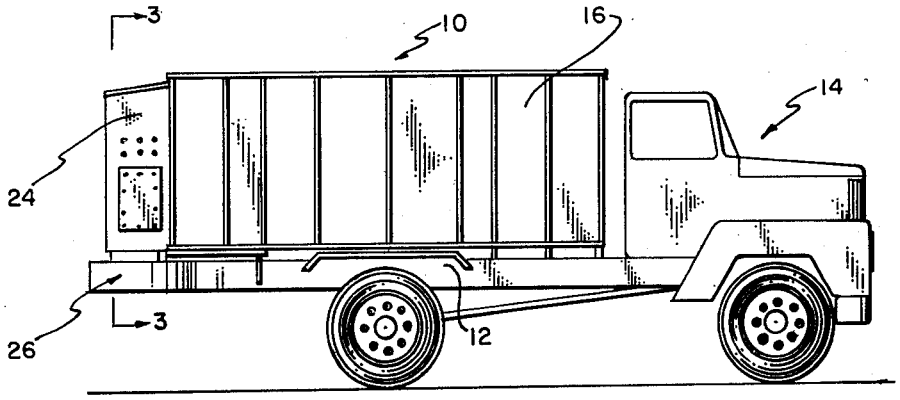
FIG. 1 is a perspective view of the invention on the bed of a truck.
Figure 2:
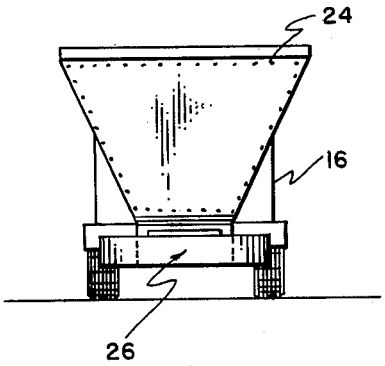
FIG. 2 is a side elevational view of the invention and the truck in FIG. 1.
Figure 3:
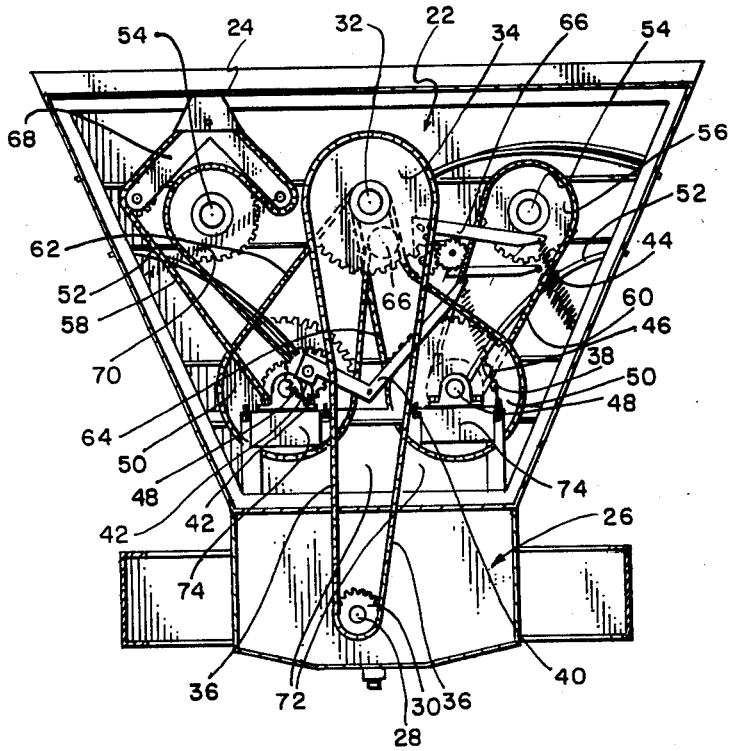
FIG. 3 is a vertical sectional view taken in direction of the arrows and along the plane of line 3—3 in FIG. 1.
Figure 4:
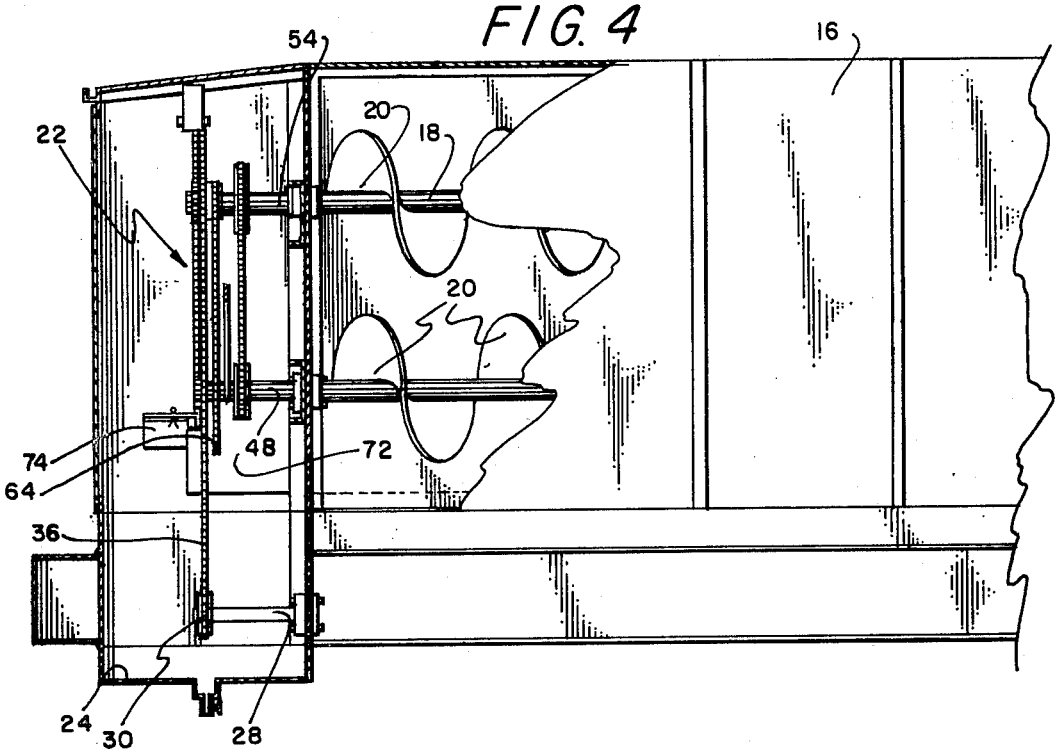
FIG. 4 is a cut-away front elevational view of the invention disclosing the augers and the chain-sprockets combination that rotates the augers.
Figure 5:
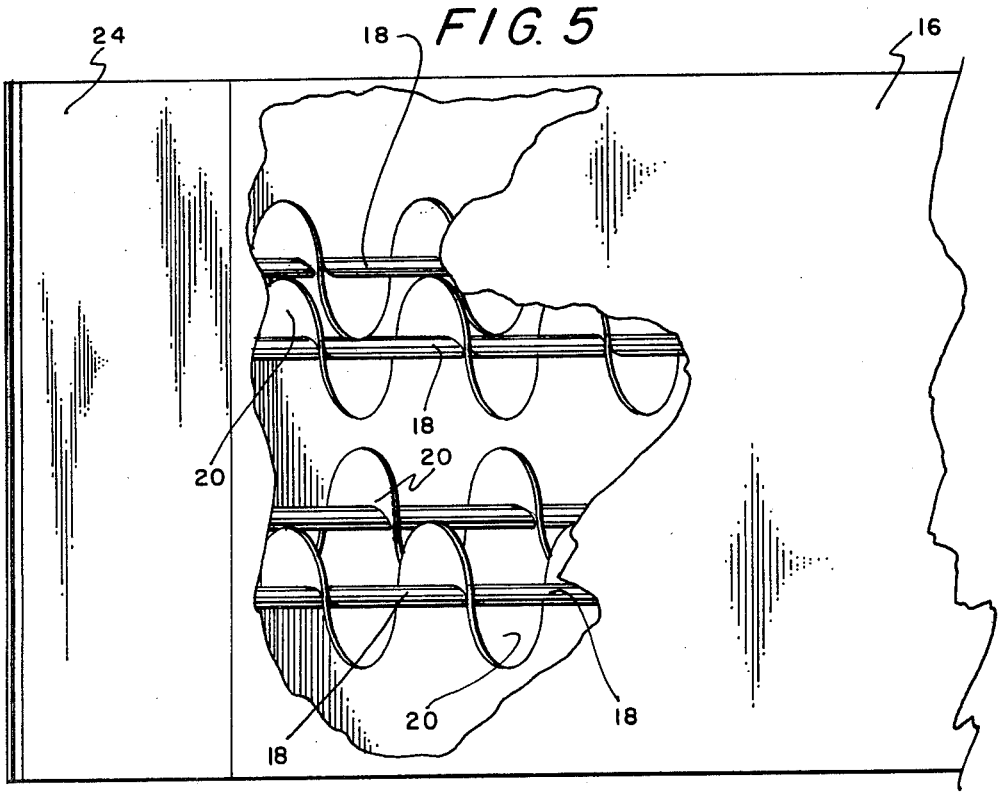
FIG. 5 is a cut-away top plan view of the invention disclosing the augers with their flight sections.

Auger driving means 22 comprises a lower shaft 28 and sprocket 30 attached thereto situated in the lower oil tank 26, as shown in FIGS. 3 and 4. An upper shaft 32 and sprocket 34 means is situated in compartment 24, and drive chain 36, while engaging around sprockets 30,34, is in contact with the oil in lower oil tank 26 wherefrom drive chain 36 picks up oil for self-oiling and scrubbing of the features included within the auger driving means 22. A spring-loaded tension idler 38 is positioned and attached within the compartment 24 and engages as shown in FIG. 3 drive chain 36 achieving satisfactory tensioning of the same during operation. Tension idler 38 includes an idler arm 40, idler sprocket 42, idler spring 44, idler chain 46 which is adjustably secured to the compartment 24 by a pin not shown in the drawings.

Auger driving means 22 additionally comprises a pair of lower auger shaft 48-sprocket 50 combinations hydraulically power driven via hydraulic lines 52—52 communicating with hydraulic power takeoff from the truck 14. A pair of upper auger shaft 54-sprocket 56 means (see FIG. 3 for all shafts and sprockets) is positioned on each side of shaft 32-sprocket 34 means. Chain 58 and 60 respectively engage one of the lower auger shaft 54-sprocket 50 means combinations and one of upper auger shaft 54-sprocket 56 means combinations. Endless chain 62 and 64 respectively engage one of the lower auger shaft 54-sprocket 50 means combinations and the shaft 32-sprocket 34 means. Chains 58, 60, 62 and 64 are each preferably engaged by a spring-loaded tension idler 66 constructed similarly with the similar parts (as shown in FIG. 3) as tension idler 38 for achieving satisfactory tension of each of the same during operations.

Chain 58 may engage one of the shaft 54-sprocket 56 means combinations as chain 60 does if both shaft 54-sprocket 56 means combinations are to rotate in the same clockwise or counterclockwise direction. If a reverse rotation is desired on one of the shaft 54-sprocket 56 means combinations, a rocket arm 68 with sprockets 70—70 (see FIG. 8) is secured over the preferred reversed rotatable shaft 54-sprocket 56 means combination as illustrated in FIG. 3 in order to sprocket chain 58 as shown through the arm 68 such as to reverse the rotation on the preferred reversed rotatable shaft 54-sprocket 56 means combination. Rocker arm 68 additionally has a rocker arm spring loaded means 70 attached to the arm 68 and to the compartment 24.

Figure 12:
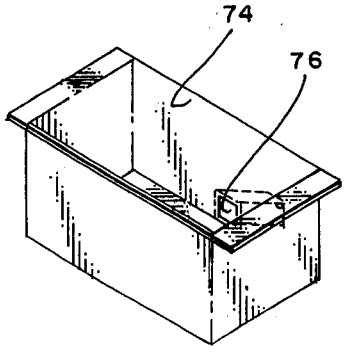
FIG. 12 is a perspective view of an oil splash pan.

Compartment 24 also includes an upper oil tank means 72 similarly including a reservoir of oil as lower tank 26. Chains 62 and 64 and shaft 48-sprocket 50 means combinations are in contact with the oil in tank means 72 such that chains 62, 64 pick up oil from tank means 72 for additional self-oiling and scrubbing of the features included within the auger rotating driving means 22. A pair of oil feed splash pans 74—74, having spout 76 (see FIG. 12) in drainage communication with tank means 72, are secured to tank means 72 as illustrated in FIGS. 3 and 4 for catching oil drippings from chain 36 and as the oil from chain 36 (and chains 62 and 64) splashes against the features of the auger rotating driving means 22 in order to subsequently drain back into tank means 72 through spout 76.

Lower oil tank means 26 (see FIG. 9) includes a bottom 80 with a sump 82 wherein a magnetic plug 84 is secured for attracting and holding metallic objects. A removable inspection plate 86 and reinforcement plate 88 are secured to the front wall 90 of the tank means 26. The rear wall 92 includes shaft aperture 94, seal 96, and ring 98 wherethrough lower shaft 28 rotatably passes.

With continuing reference to the drawings for operation of the apparatus 10, particulate material is introduced into mixing chamber 16 and motor(s) (not particularly shown in the drawings) powered via hydraulic lines 52 from the hydraulic system of the truck 14 commences to rotate the shaft 48-sprocket 50 means combination which in turn starts the rotation through chains 58, 60, 62, 64 and 36 of all shafts (54 and 28 and 32) and accompanying sprockets (56 and 30 and 34), respectively, in order to rotate the augers 18 to mix the particulate material in the mixing chamber 16. Chain 36 picks up oil from the lower oil tank means 26 for self-oiling and scrubbing of the features included within the auger rotating driving means 22 simultaneous to the moving and mixing of the particulate matter in the mixing chamber 16. Oil feed splash pans 74—74 catch oil drippings from chain 36 and the splashes of oil off and against the features of the auger rotating driving means. Oil in pans 74—74 drains into upper oil tank means 72 through spout 76. Oil in the upper tank means 72 is also picked up by chains 62 and 64 for additional self-oiling and scrubbing of the features in the auger rotating driving means 22. Any splashes or drippings from chains 62 and 64 may also be caught by pans 74—74, While the present invention has been described herein with reference to particular embodiments thereof, a lattitude of modifications, various changes and substitutions are intended in the foregoing disclosure and it will be appreciated that in some instances some features of the invention will be employed without a corresponding use of other features without departing from the scope of the invention as set forth.

I claim:

1. An apparatus for mixing particulate material in the bed of a truck comprising: a mixing chamber; a plurality of auger means rotatably disposed within said mixing chamber for moving and mixing said particulate material; auger driving means engaging said auger means for rotating the same, said auger driving means including a master drive chain means; an auger driving housing for housing said auger driving means; power means for powering auger driving means; and a lower oil tank means secured to said housing and containing a reservoir of oil in contact with the drive chain means and wherefrom the drive chain means picks up oil for self-oiling and scrubbing of the features included within the auger rotating driving means; said auger driving housing comprises an upper oil tank means including an upper reservoir of oil in contact with certain features of the auger rotating driving means for additional self-oiling and scrubbing of the features included within the auger rotating driving means; at least one oil feed splash pan means having a spout means in communication with the upper oil tank means and disposed within the housing for catching oil dripping from the master drive chain means and splashing against the other features of the auger rotating driving means; said auger driving means comprises a lower shaft-sprocket combination means secured within the lower oil tank means and an upper shaft-sprocket combination means disposed within said housing, a master endless chain means engages the lower shaft-sprocket combination means and the upper shaft-sprocket combination means while a master spring-loaded tension idler means is positioned and attached within said housing and engages the master endless chain means for achieving satisfactory tensioning of the master chain means during operation; said auger driving means additionally comprises a pair of lower auger shaft-sprocket combination means and a pair of upper auger shaft-sprocket combination means, a first auger chain means inter-engaging one of the lower auger shaft-sprocket combination means and one of the upper auger shaft-sprocket combination means, a second auger chain means inter-engaging the remaining lower auger shaft-sprocket combination means and the remaining upper auger shaft-sprocket combination means, a first auger upper shaft-sprocket chain means inter-engaging one of the lower auger shaft-sprocket combination means and the upper shaft-sprocket combination means and a second auger upper shaft-sprocket chain means inter-engaging the remaining lower auger shaft-sprocket combination means and the upper shaft-sprocket combination means, each of said first and second auger chain means and said first and second auger upper shaft-sprocket chain means being engaged by a spring-loaded tension idler means positioned and attached within said housing for achieving satisfactory tension of each of the same during operation; said apparatus additionally comprising a rocker arm means secured within said housing in proximity to one of the upper auger shaft-sprocket combination means, said rocker arm means additionally having a rocker arm spring-loaded means attached to the rocker arm means and to the housing.

2. The apparatus of claim 1 wherein said lower oil tank means comprises a bottom with a sump, a magnetic plug secured within said sump for attracting and holding metallic objects, and a removable inspection plate secured to the front wall of the lower oil tank means for removing in order to inspect the inside of said lower oil tank means.

3. The apparatus of claim 2 additionally comprising a hydraulic power drive means communicating with and engaging each of the pair of lower auger shaft-sprocket combination means to define said power means which powers the auger driving means.

4. A method for moving and mixing particulate matter in a mixing chamber on the bed of a truck comprising:

(a) disposing a plurality of rotatable augers within said mixing chamber;

(b) engaging the augers of step (a) with auger driving means having a master drive chain means powered from power transmitted to the auger driving means;

(c) housing the auger driving means;

(d) securing a lower oil tank means having a reservoir of oil to the housing of step (c);

(e) contacting the drive chain means of step (b) with the oil of step (d) such that the drive chain means picks up oil from the lower oil tank means for self-oiling and scrubbing of the features included within the auger rotating driving means simultaneous to the moving and mixing of the particulate matter in the mixing chamber;

(f) contacting other certain features included within the auger rotating driving means with oil in an upper oil tank means disposed within said housing of step (c) in order to additionally self-oil and scrub the feature of the auger rotating driving means; and (g) positioning at least one oil feed splash pan means, having a spout means in communication with the upper oil tank means, in the housing of step (c) for catching oil drippings from the master drive chain means and splashing against the other features of the auger rotating driving means.

* * * * *